US012312754B2

(12) United States Patent
Neusch et al.

(10) Patent No.: US 12,312,754 B2
(45) Date of Patent: May 27, 2025

(54) COUNTERWEIGHT DEPLOYABLE VEHICLE BARRIER

(71) Applicant: Neusch Innovations, LP, Marble Falls, TX (US)

(72) Inventors: William H. Neusch, Marble Falls, TX (US); Peter Lewellen, Bertram, TX (US)

( * ) Notice: Subject to any disclaimer, the term of this patent is extended or adjusted under 35 U.S.C. 154(b) by 782 days.

(21) Appl. No.: 17/566,514

(22) Filed: Dec. 30, 2021

(65) Prior Publication Data

US 2022/0205198 A1 Jun. 30, 2022

Related U.S. Application Data

(60) Provisional application No. 63/132,462, filed on Dec. 30, 2020.

(51) Int. Cl.
*E01F 13/04* (2006.01)

(52) U.S. Cl.
CPC ..... *E01F 13/046* (2013.01); *E01F 13/048* (2013.01)

(58) Field of Classification Search
CPC ..... E01F 13/046; E01F 13/048; E01F 13/12
See application file for complete search history.

(56) References Cited

U.S. PATENT DOCUMENTS 1,574,908 A * 3/1926 Lamp ..... E01F 9/646 362/413
2,212,504 A * 8/1940 Roberts ..... E01F 13/046 292/164
3,698,135 A * 10/1972 Boots ..... E01F 13/046 49/35
3,963,363 A 6/1976 Roper
4,576,508 A 3/1986 Dickinson
(Continued)

FOREIGN PATENT DOCUMENTS

EP 627527 A1 * 12/1994 ..... B65F 1/1457
EP 2267226 A2 12/2010
(Continued)

OTHER PUBLICATIONS

International Search Report and Written Opinion, PCT/US2021/065605, Apr. 13, 2022.
(Continued)

*Primary Examiner* — Gary S Hartmann
(74) *Attorney, Agent, or Firm* — Bradley Arant Boult Cummings LLP; Henry L. Ehrlich

(57) ABSTRACT

A deployable vehicle barrier includes an upper structure forming a vertical passage, opposed legs extending vertically downward from the upper structure, each of the legs having a channel, a bollard disposed in the passage, parallel plates having a vertical section inside of the bollard and a horizontal section positioned outside of a bottom end of the bollard with the horizontal sections located in the channels, a first belt connector attached to and extending normal to the horizontal section, a second belt connector attached to and extending normal to the horizontal section in an opposite direction from the first belt connector, a first belt attached to the first belt connector, the upper structure via a first pulley, and a first counterweight, and a second belt attached to the second belt connector, the upper structure via a second pulley, and a second counterweight.

7 Claims, 9 Drawing Sheets

(56) References Cited

U.S. PATENT DOCUMENTS

| | | | | |
|---|---|---|---|---|
| 4,715,742 | A | 12/1987 | Dickinson | |
| 5,192,159 | A * | 3/1993 | Higginson | E01F 13/046 404/11 |
| 5,271,183 | A * | 12/1993 | Hahn | E05F 15/665 49/73.1 |
| 5,975,792 | A | 11/1999 | Goeken | |
| 6,485,225 | B1 | 11/2002 | Baker | |
| 6,997,638 | B2 | 2/2006 | Hensley et al. | |
| 7,889,505 | B1 * | 2/2011 | Beard | H04R 1/025 361/730 |
| 8,226,322 | B2 | 7/2012 | Blair | |
| 8,579,540 | B2 | 11/2013 | Lafont et al. | |
| 9,133,589 | B2 | 9/2015 | Ball | |
| 9,139,967 | B2 * | 9/2015 | Sharipov | E01F 13/046 |
| 10,221,531 | B2 | 3/2019 | Plavada | |
| 10,385,528 | B2 * | 8/2019 | Heald | E01F 9/646 |
| 2012/0134745 | A1 | 5/2012 | Blair | |
| 2012/0230764 | A1 * | 9/2012 | Lafont | E01F 13/046 404/6 |
| 2014/0328621 | A1 | 11/2014 | Broadhurst et al. | |
| 2015/0050084 | A1 * | 2/2015 | Berto | F21V 33/0076 404/6 |
| 2016/0115661 | A1 | 4/2016 | Neusch | |
| 2018/0209108 | A1 | 7/2018 | Plavada | |

FOREIGN PATENT DOCUMENTS

| | | | | |
|---|---|---|---|---|
| FR | 2777578 | A1 * | 10/1999 | E01F 13/046 |
| FR | 2782330 | A1 * | 2/2000 | E01F 13/046 |
| FR | 3080865 | A1 * | 11/2019 | E01F 13/046 |
| GB | 2281927 | A * | 3/1995 | E01F 13/046 |
| JP | 07138922 | A * | 5/1995 | E01F 13/046 |
| KR | 1020130126393 | A | 11/2013 | |
| KR | 1015423366 | B1 | 8/2015 | |
| WO | WO-2020121039 | A1 * | 6/2020 | E01F 13/046 |

OTHER PUBLICATIONS

Delta Scientific DSC720 Counterweight Bollard General Arrangement.

Nasatka Security NMSB VI-E Bollards, 4-pgs.

* cited by examiner

COUNTERWEIGHT DEPLOYABLE VEHICLE BARRIER

BACKGROUND

This section provides background information to facilitate a better understanding of the various aspects of the disclosure. It should be understood that the statements in this section of this document are to be read in this light, and not as admissions of prior art.

Vehicle barrier systems are used to protect premises and people from the unauthorized entry of vehicles. Anti-ram vehicle barriers (AVB) systems or vehicle security barriers (VSB) are configured to stop motor vehicles, such as trucks, that crash into the barrier. Some AVBs are designed to stop vehicles that are intentionally crashed into the barrier in an attempt to enter the protected area for nefarious purposes.

Some anti-ram vehicle barriers are crash tested to ensure compliance with and obtain certification from a recognized standard. For example, the American Standard Test Method (ASTM F2656 and F3016), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb (6800 kg) and the nominal velocities were 30 mph (50 km/h), 40 mph (65 km/h) and 50 mph (80 km/h). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and a heavy goods truck. ASTM F2656-07 maintained three predetermined impact velocities for each vehicle category and penetration is measured from the rear face of the barrier and classified into four categories of penetration rating. The penetration ratings include P1 for less than or equal to 1 m (3.3 ft); P2 for 1.10 to 7 m (3.31 to 23.0 ft); P3 for 7.01 to 30 m (23.1 to 98.4 ft); and P4 for 30 m (98 ft) or greater. ASTM F2656 was revised in 2015 (ASTM F2656-15) to include two additional vehicle types, a full-sized sedan and a cab over/cab forward class 7 truck and it excluded the lowest penetration rating (P4). Vehicle categories include M-ratings: medium duty truck (15,000 lb); C-rating: small passenger car (2,430 lb); PU-rating: pickup truck (5,070 lb); and H-ratings: heavy goods vehicle (65,000 lb). As an example, an M-rating is an equivalent vehicle as a K-rating. An M50-P1 certified barrier has been tested by impacting a 15,000 lb vehicle travelling perpendicular to the barrier at 50 mph and stopping the vehicle within 1 meter of the barrier.

ASTM F3016 establishes standards for anti-ram at low speeds. Whereas ASTM F2656 addresses greater speeds and different weight vehicles such as may be used in an intentional act, such as a terrorist attack, ASTM F3016 addresses standards for vehicle safety barriers to protect pedestrians and storefront property. Storefronts, bus stops, restaurant patios, sidewalks, propane tanks, and gasoline pumps are examples of protected areas particularly suited for F3016 type vehicle safety barriers. ASTM F3016 provides for a range of low impact speeds, 20 to 60 km/h (10 to 30 mph), with a 22,250 N (5,000 lb) test vehicle. Penetration ratings are based on displacement of the barrier into the protected area or maximum intrusion of the vehicle impactor nose into the protected area. The speed ratings are S10 (20 km/h; 10 mph); S20 (35 km/h; 20 mph); and S30 (50 km/h; 30 mph) and penetration ratings are P1 (less than or equal to 0.30 m; 1 ft) and P2 (0.31-1.22 m; 1 ft). Penetration of greater than P2 is a failure.

In 2005, the British Standard Institute (BSI) published PAS 68:2005 Specification for Vehicle Barriers: Fixed Bollards. The standard has been to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a five-to-seven-part classification code, the includes: Classification of Test/Gross Weight of Vehicle (kg) (Vehicle Class)/Impact Speed/Angle of Impact: Distance Leading Edge of Load Bay travels beyond the Original Position of Rear Face/Dispersion Distance of major debris weighing 25 kg or more from the barrier to establish stand-off distance. For example, a barrier (bollard) tested by impact by a 7500 kg day cab ("V") at a ninety-degree angle traveling 80 km/h and resulting in penetration of 7.5 m with significant debris scattered up to 20.0 m away would be designated as V/7500(N3)/80/90:7.5/20.0. The dispersion distance may be used to determine a stand-off distance for example to mitigate damage from a vehicle born improvised explosive device (VBIED).

The European Committee for Standardization (CEN) recognized across 34 European countries has produced a standard CWA 16221 that combines details of PAS 68 and PAS 69. PAS 69 provides guidance on the barrier's use and installation.

In 2013, the International Works Agreement (IWA) 14-1: 2013 was published to provide an international specification for crash-testing. The system was developed by government agencies, military bodies and providing companies from the USA, UK, Germany, Norway, Oman, Singapore, and Syria. This standard includes a merging of vehicle impact test specifications of the British PAS 68 and the American ASTM F2656. This international standard assesses vehicle barrier performance based on nine types of test vehicles with up to seven test speeds. Penetration is measured from the front (attack side) face of the AVB. The IWA 14 classification code represents Vehicle Impact Test/Gross Weight of Vehicle (Vehicle Class)/Impact Speed/Angle of Impact/Penetration beyond the original position of the Front/Impact face.

Vehicle safety barriers may be designated or marketed as crash-rated, certified, or engineer-rated. Certified or crash-rated systems have been crash-tested and certified by an independent testing facility pursuant to a referenced testing standard, e.g., ASTM, PAS, IWA. Engineered or engineer-rated systems have been designed and computer-analyzed to meet a designation within a referenced standard but not crashed tested or certified.

SUMMARY

An exemplary deployable vehicle barrier includes an upper structure forming a vertical passage, opposed legs extending vertically downward from the upper structure, each of the legs having a channel, a bollard disposed in the passage, parallel plates having a vertical section inside of the bollard and a horizontal section positioned outside of a bottom end of the bollard with the horizontal sections located in the channels, a first belt connector attached to and extending normal to the horizontal section, a second belt connector attached to and extending normal to the horizontal section in an opposite direction from the first belt connector, a first belt attached to the first belt connector, the upper structure via a first pulley, and a first counterweight, and a second belt attached to the second belt connector, the upper structure via a second pulley, and a second counterweight.

Another exemplary deployable vehicle barrier includes an upper structure having opposed first and second sidewalls and a top plate and a bottom plate forming a vertical passage, opposed legs extending vertically downward from the bottom plate, each of the legs having a channel, a bollard disposed in the passage, parallel plates having a vertical section inside of the bollard and a horizontal section positioned outside of a bottom end of the bollard with the horizontal sections located in the channels, a first belt connector attached to and extending normal to the horizontal section, a second belt connector attached to and extending normal to the horizontal section in an opposite direction from the first belt connector, a first belt attached to the first belt connector, the first sidewall via a first pulley, and a first counterweight, a second belt attached to the second belt connector, the second sidewall via a second pulley, and a second counterweight, and a motor coupled to first belt.

An exemplary bollard includes a steel tubular and parallel steel plates having a vertical section inside of the tubular and a horizontal section positioned outside of a bottom end of the tubular and extending radially outward from the tubular. The bollard may further include a first arm attached to the horizontal section and extending radially from the tubular and a second arm attached to the horizontal section and extending radially from the tubular in an opposite direction from the first arm.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
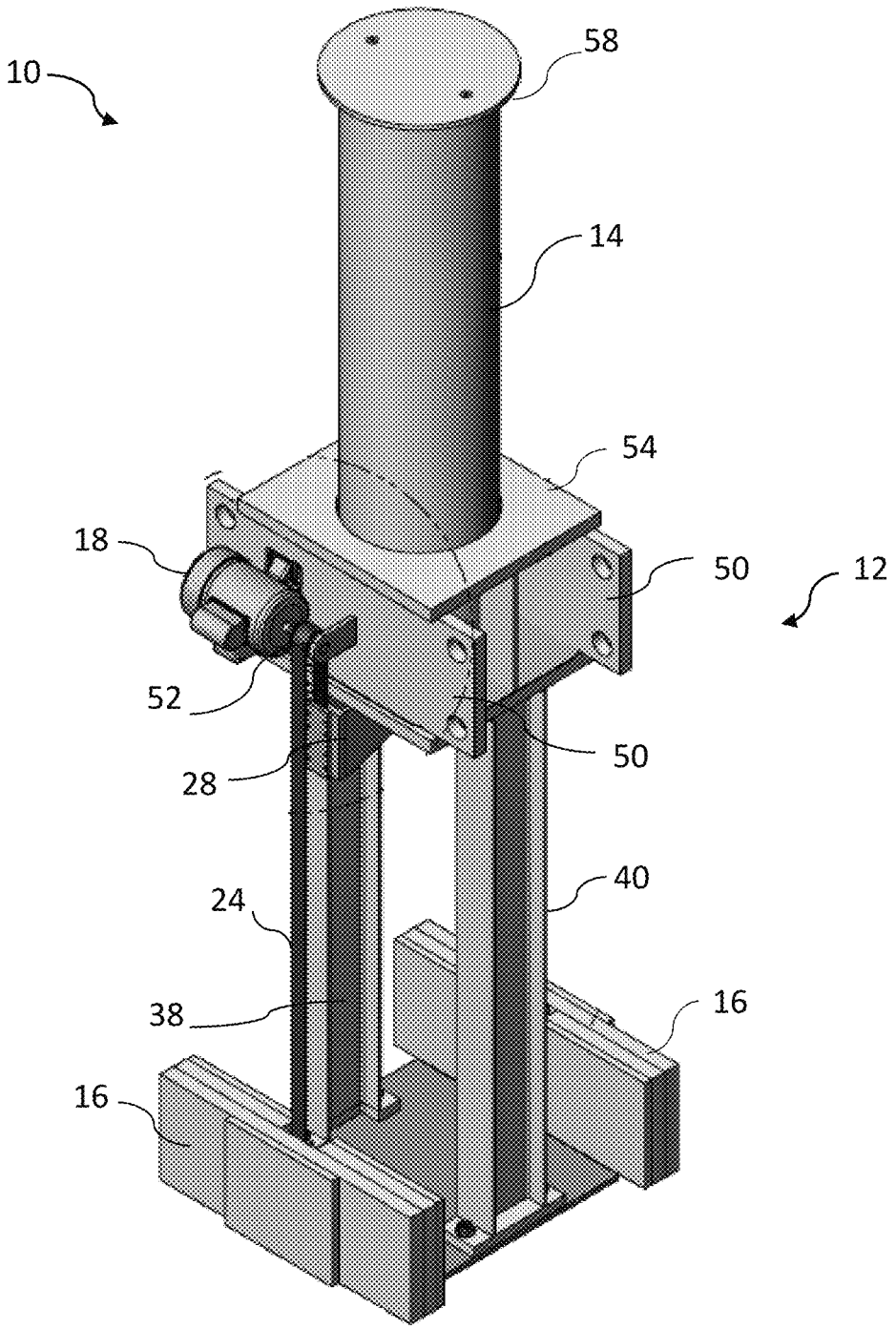
FIG. 1 is a perspective view of an exemplary counterweight deployable vehicle barrier in a deployed position.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

The figures illustrate exemplary embodiments of counterweight vehicle barrier bollard assembly configured to be crash-rated by certifying agencies such as DOD, DOS, American Standard Test Method (ASTM), British Standards Institution (BSI) and International Standardization Institution (ISO). Some embodiments of the counterweight bollard assembly may be engineered crash-rated but not crash tested. Some embodiments of the counterweight bollard may not be engineered crash-rated, or crash tested.

As is known in the art, protective vehicle barriers are erected to separate a protected area on one side of the barrier from vehicles approaching from the opposite side of the barrier, which is often referred to as the attack or threat side. Although a vehicle barrier may be bi- or multi-directional and thus capable of stopping or impeding a vehicle approaching from different directions, vehicle barriers are commonly configured to have a higher resistance to vehicle penetration from the threat side to the protected side or generally parallel to a threat-protected axis.

The figures illustrate exemplary aspects of a counterweight or counter-balance deployable vehicle barrier. The exemplary embodiments are configured to be automated and utilize a motor in combination with counterweights to move the barrier (e.g., bollard) from a retracted position to a deployed, raised, position. The barriers may be in communication with sensors and the like to automatically actuate the barrier in response to sensed parameters. The counterweight deployable barrier may be configured to be manually raised and lowered without use of a motor.

Figure 2:
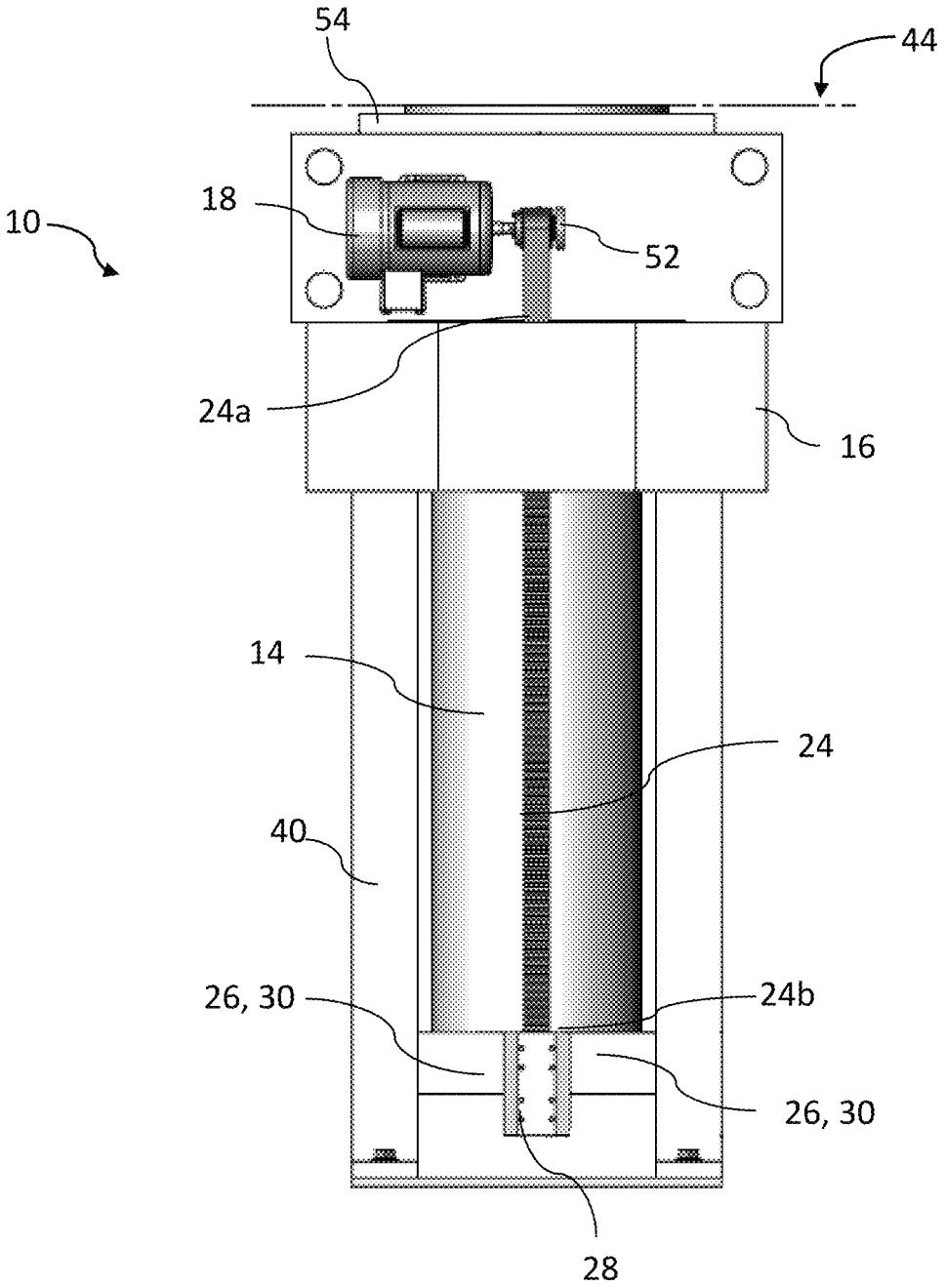
FIG. 2 is a side view of the exemplary counterweight deployable vehicle barrier of FIG. 1 in a retracted position.
Figure 3:
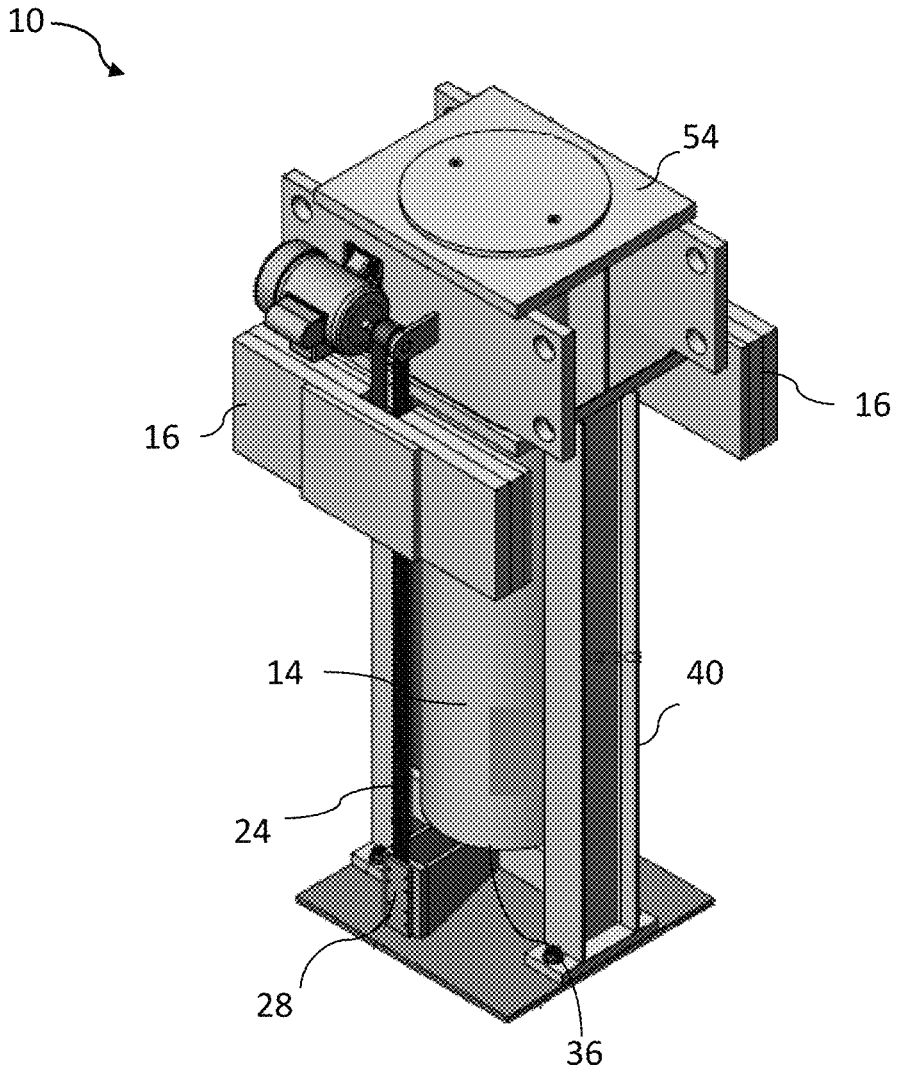
FIG. 3 is a perspective view of the exemplary counterweight deployable barrier of FIG. 1 in a retracted position.
Figure 4:
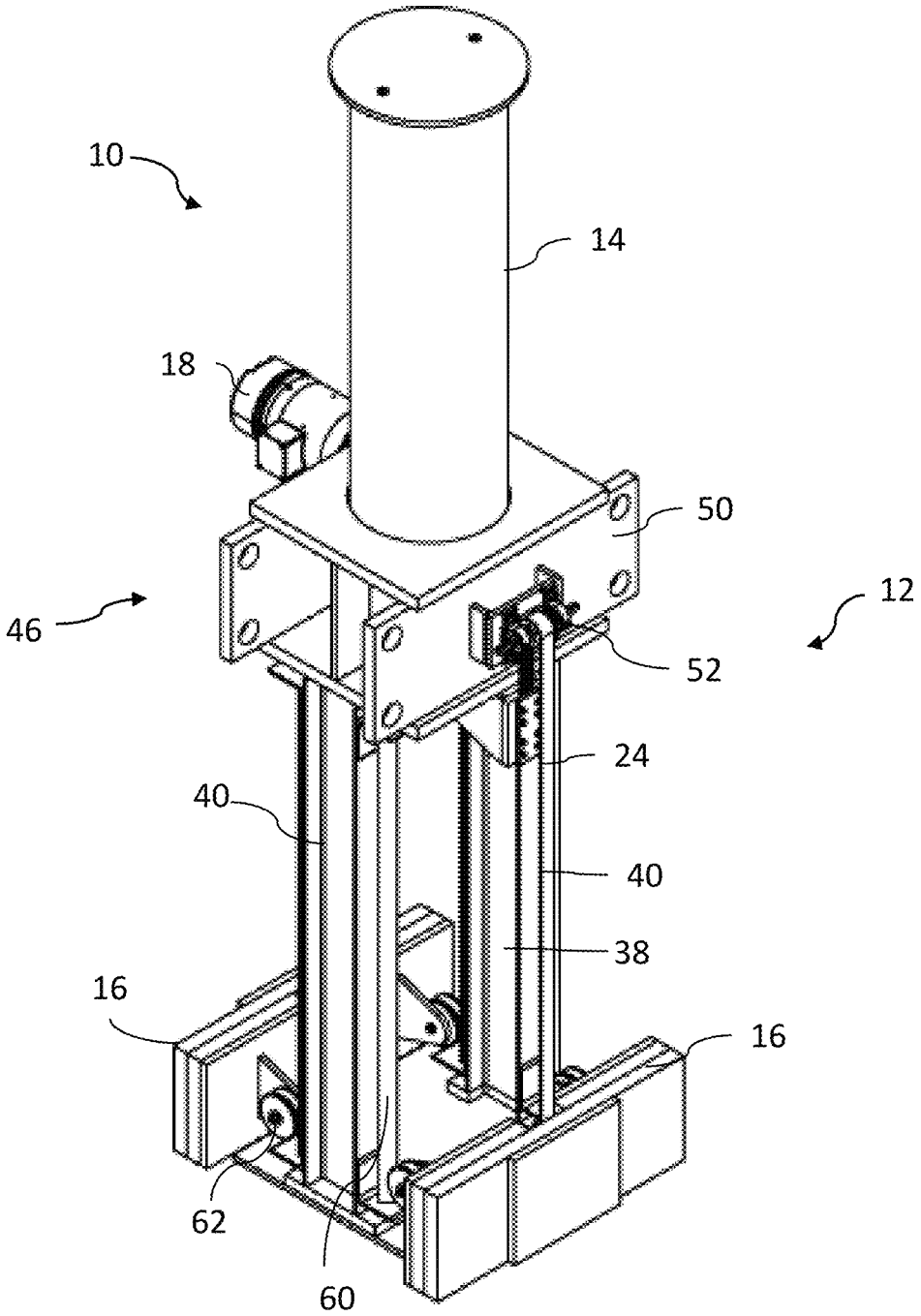
FIG. 4 is a perspective view of another exemplary counterweight deployable vehicle barrier in a deployed position.
Figure 11:
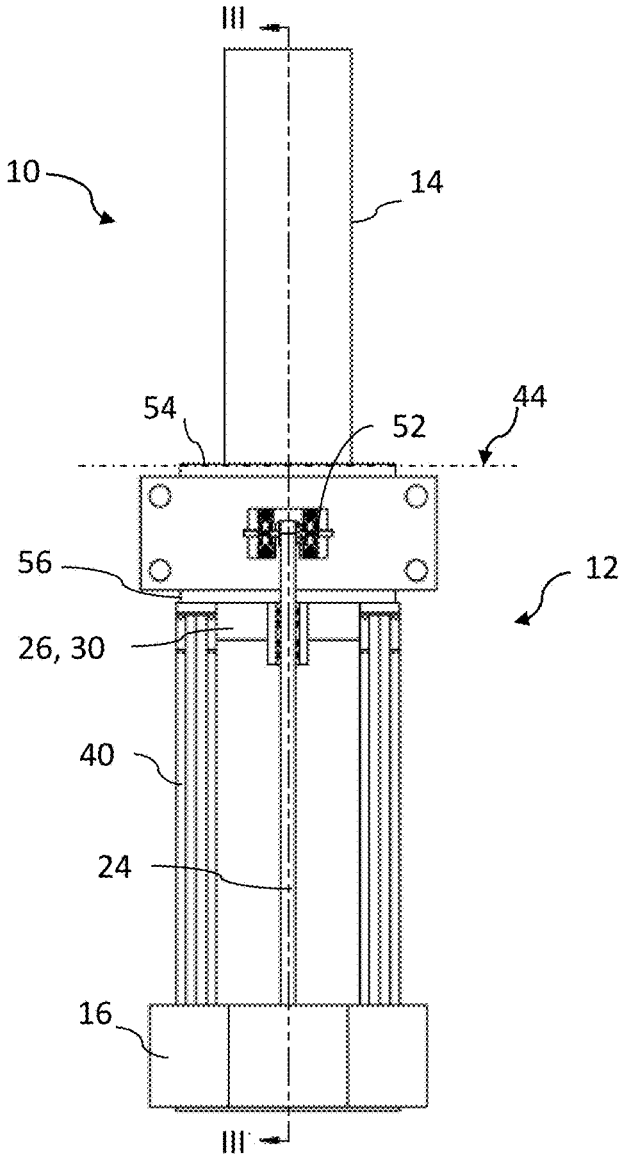
FIG. 11 is a side view of an exemplary counterweight deployable vehicle barrier.
Figure 12:
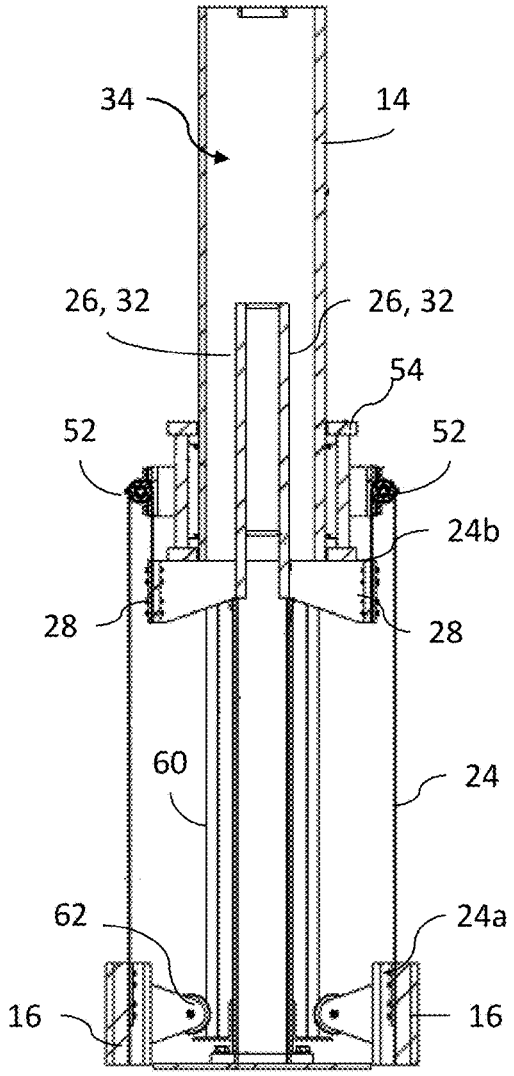
FIG. 12 is a sectional view along the line of FIG. 11.

FIGS. 1-3 and illustrate an exemplary embodiment of a counterweight deployable vehicle barrier assembly, or capsule, generally denoted by the numeral 10. FIGS. 4 and 11-12 illustrate another exemplary embodiment of a counterweight deployable vehicle barrier assembly 10. FIGS. 5-10 and 13 illustrate aspects of exemplary barrier assemblies 10.

Barrier capsule 10 may include a frame 12, bollard (e.g., pipe) 14, counterweight 16, and a motor 18. Bollard 14 moves vertically relative to frame 12 between a deployed position (FIGS. 1, 4, 11-12) and a retracted position (FIGS. 2-3, 6, and 13). In use, illustrated for example in FIG. 13, barrier assembly 10 can be positioned inside of a vault 20 that can be set in the ground 22 in concrete. The vault may be concrete.

Barrier assembly 10 may be automated to raise and lower in response to a trigger or may be manually actuated. The primary lift mechanism in an exemplary embodiment is mirrored counterweights 16. The counterweights are on opposite sides of bollard 14 and serve dual functions. The counterweights reduce the force required to move bollard 14 vertically and ensure that the bollard is balanced to assist in smooth operation. In an exemplary embodiment, heavy-duty fiberglass reinforced neoprene belts 24 connect the counterweights to the bollard and allow movement through pulleys. The fiberglass reinforced neoprene belts provide for a wide range of operating temperatures and withstand exposure to corrosive environments. Belts 24 may be chains or the like. An exemplary embodiment, a motor 18 is connected to one of the belts. The motor may be for example an electric or hydraulic motor. An exemplary motor is a ⅓ HP motor with a 15:1 speed reducer.

Figure 13:
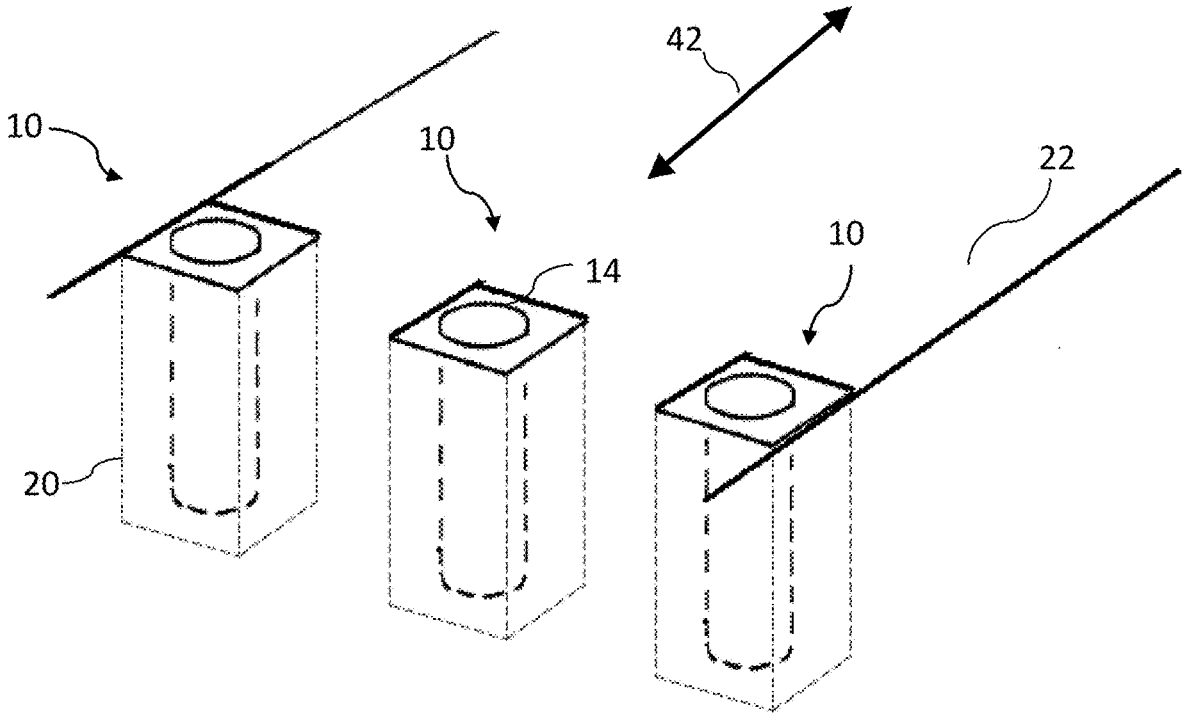
FIG. 13 illustrates exemplary counterweight deployable vehicle barriers located in a vehicle pathway.

Bollard 14 is, for example, a steel tubular. Bollard 14 is constructed as a bollard unit 14*a* (FIG. 5) including for example one or more stiffener plates 26 and belt connectors 28. An exemplary bollard unit is described with reference in particular to FIGS. 5, 7, 8, and 12. Stiffener plates 26 are T-shaped members, e.g., steel plates, with a horizontal section 30 and a central vertical section 32. Vertical section 32 is disposed in the bore 34 of bollard 14 with horizontal section 30 positioned outside of the bottom end 36 of bollard 14. Horizontal section 30 extends radially outward from bollard 14 on opposite sides. Horizontal sections 30 are positioned in the opposed channels 38 of opposed legs 40. In an exemplary embodiment, the bollard unit includes two parallel stiffener plates 26, which in an exemplary embodiment are oriented generally parallel with the expected direction of travel of an impacting vehicle, i.e., threat axis 42 (FIG. 13). Vertical section 32 extends to a height above ground level 44 (FIGS. 2, 11) when bollard 14 is deployed. Belt connectors 28, e.g., aluminum plates, extend normal to stiffener plates 26 and radially on opposite sides of the stiffener plates. Belt connectors 28 in the illustrated exemplary embodiments are located external of bollard 14. Stiffeners 26 and belt connectors 28 may be secured to the bollard for example by welds.

Figure 5:
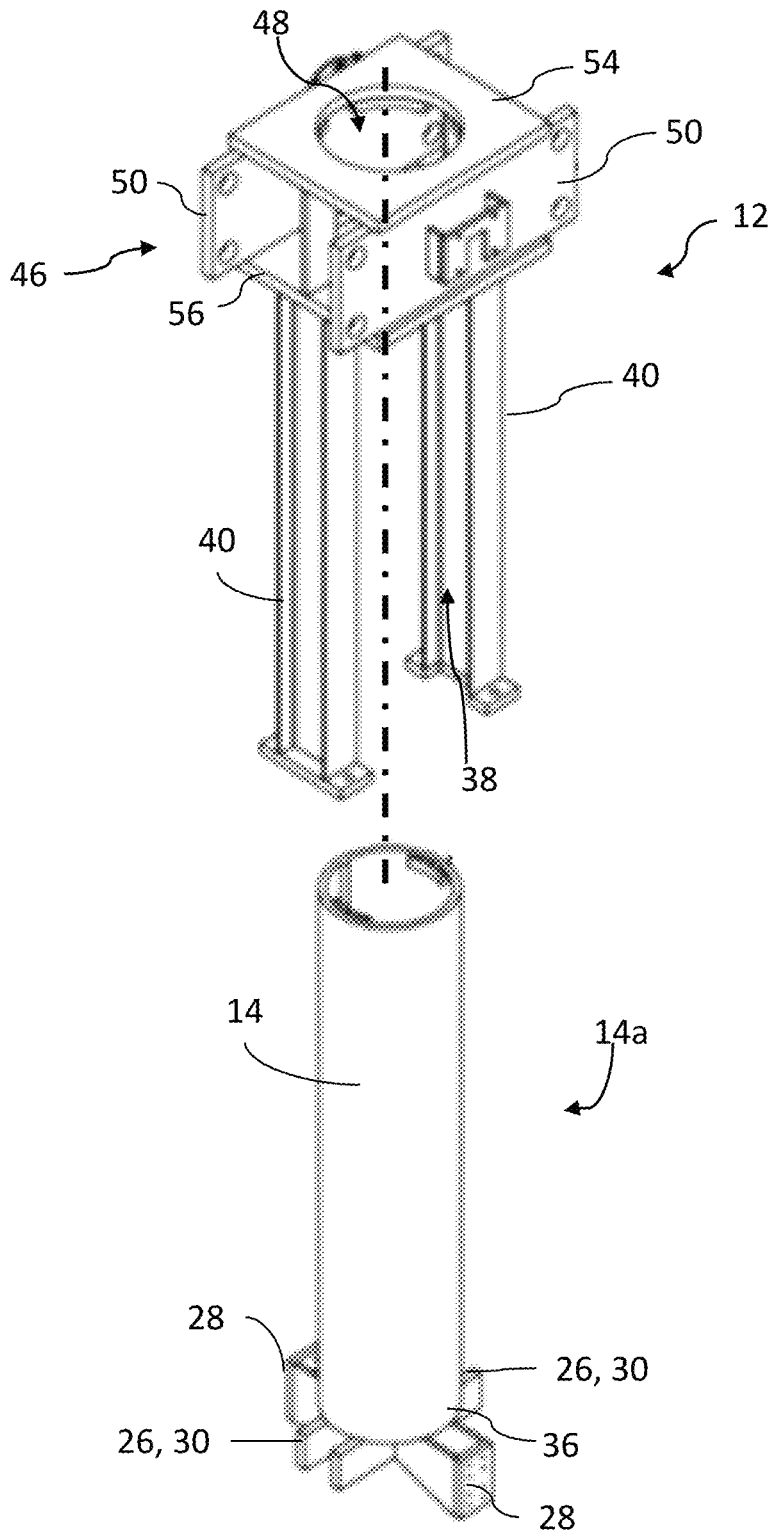
FIG. 5 is an exploded view of portions of an exemplary counterweight deployable vehicle barrier.
Figure 6:
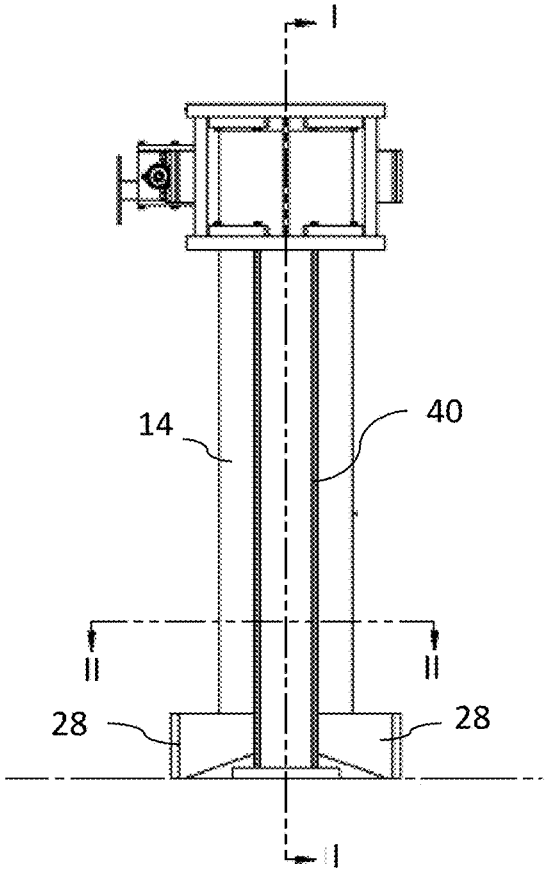
FIG. 6 is a front view along a threat-protected axis of a portion of an exemplary counterweight deployable vehicle barrier.
Figure 7:
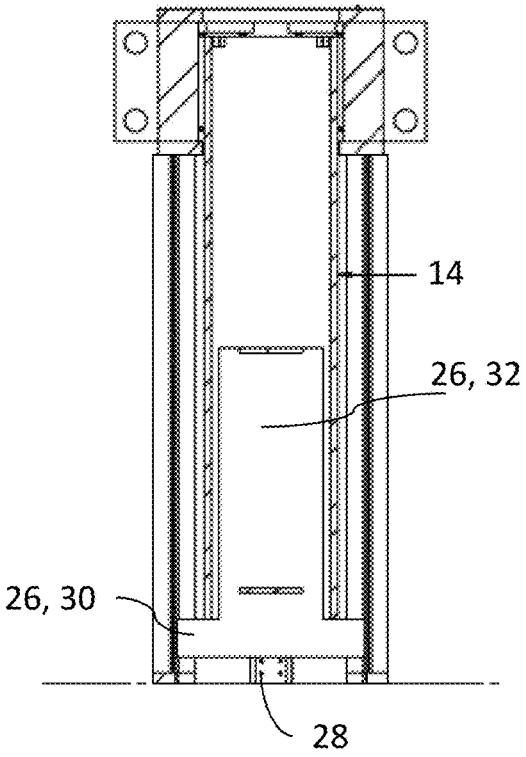
FIG. 7 is a sectional view along the line I-I of FIG. 6.
Figure 8:
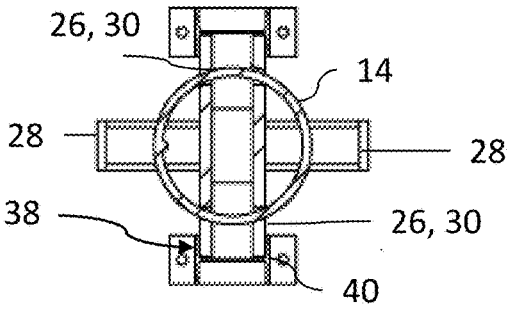
FIG. 8 is a sectional view along the line II-II of FIG. 6.
Figure 9:
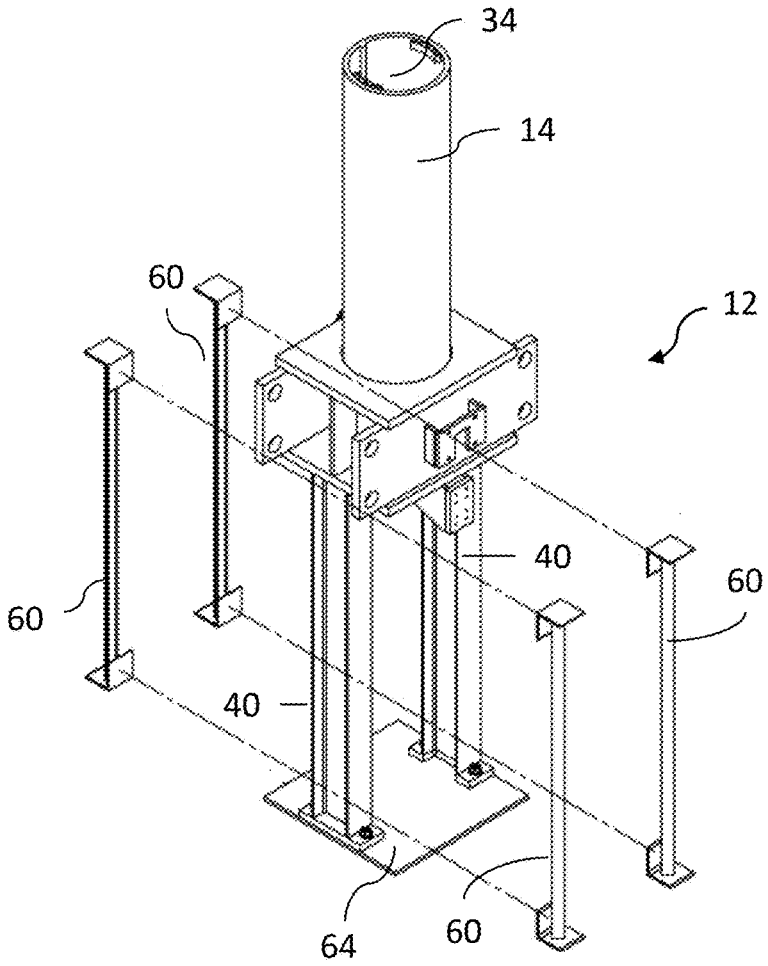
FIG. 9 is an exploded view of portions of an exemplary counterweight deployable vehicle barrier.
Figure 10:
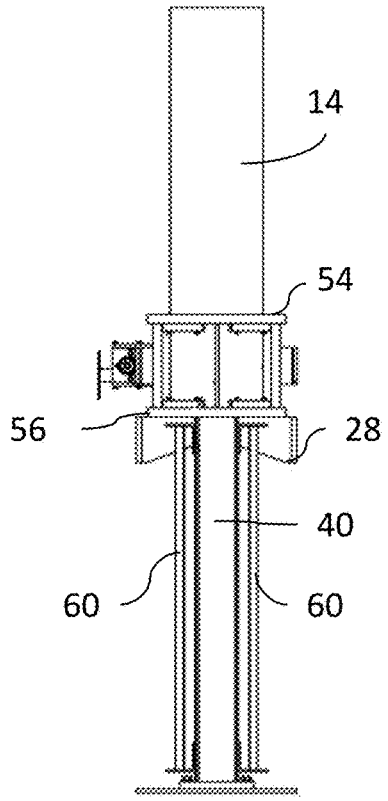
FIG. 10 is a front view of an exemplary counterweight deployable vehicle barrier.

With reference in particular to FIG. 5, frame 12 generally includes an upper structure 46 to be located proximate the ground level. Upper structure 46 forms a vertical passage 48 in which bollard 14 is positioned and vertically moves and opposed sidewalls 50 for mounting the pulleys 52 for the dual counterweight and a motor. In this example, upper structure 46 includes a top plate 54 and bottom plate 56. The top and bottom plates are oriented parallel and generally horizontal, parallel to ground level, each with coaxially aligned passages forming vertical passage 48. The top and bottom plates are separated a distance sufficient to resist tipping of the bollard when it is deployed and impacted by a vehicle. In an exemplary embodiment, bollard 14 has a length of about 58 inches (147 cm) and upper structure 46 has a vertical height of approximately 16 inches (41 cm), accordingly when the bollard is deployed it extends approximately 42 inches (107 cm) above top plate 54 of the frame and ground level with horizontal sections 30 of stiffener plates 26 in contact with the bottom plate 56.

Frame 12 includes a pair of opposed parallel legs 40 connected to bottom plate 56. Parallel legs 40 have a height sufficient to allow bollard 14 to be retracted so that the top end 58 of bollard 14 is generally flush with top plate 54. Opposed legs 40 may be secured to a base plate 64, see e.g., FIG. 9. Each leg 40 forms a channel 38. Channels 38 face each other and dispose horizontal sections 30 of stiffeners 26. The pair of stiffeners 26 are spaced from each other a distance corresponding with the width of channels 38 such that stiffeners do not twist inside of channels 38.

With reference to FIGS. 4 and 9-12 an exemplary barrier assembly includes vertical tracks 60 on legs 40 to guide the vertical movement of counterweights 16. For example, tracks 60 are rods, bars or plates that are located on each leg 40 on opposite sides of channel 38 and the same sides of frame 12 as sidewalls 50. Counterweights 16 have wheels 62 that mate with tracks 60. For example, the wheels are grooved wheels, and the wheel guides are generally V-shaped to mate with the grooves in the wheels Assembly of a vehicle barrier assembly 10 may include placing a bollard unit 14*a* with stiffener plates 26 and belt connections 28 on a level surface. Frame 12 is lowered onto bollard unit 14*a* with bollard 14 disposed in frame passage 48. The ends of horizontal sections 30 of the pair of stiffener plates 26 are located in opposed channels 38 of opposed legs 40.

Pulleys 52 are mounted on the opposed sidewalls 50 of frame 12. Motor 18 is mounted on one sidewall 50 and connected to a belt 24 for example via a pulley 52. The pulleys may have teeth to mate with the lifting belt. With reference in particular to FIG. 12, belts 24 have a first end 24*a* attached to counterweight 16 and a second end 24*b* attached to a belt connector 28 of bollard unit 14*a*.

With reference to FIG. 13, three barrier assemblies 10 are positioned in vaults 20 and set in the ground 22. The barrier assemblies are positioned in a location to selectively stop or limit passage of motor vehicles. Example locations includes roadways, sidewalk locations, vehicle ingresses, and structure perimeters.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Conditional language used herein, such as, among others, "can," "might," "may," "e.g.," and the like, unless specifically stated otherwise, or otherwise understood within the context as used, is intended to convey that certain embodiments include, while other embodiments do not include, certain features, elements and/or states. Thus, such conditional language is not intended to imply that features, elements and/or states are in any way required for one or more embodiments or that one or more embodiments necessarily include such elements or features.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A deployable vehicle barrier, the barrier comprising:

an upper structure forming a vertical passage;

opposed legs extending vertically downward from the upper structure, each of the legs comprising a channel;

a bollard disposed in the passage;

parallel plates each having a vertical section inside of the bollard and a horizontal section positioned outside of a bottom end of the bollard with the horizontal sections located in the channels;

a first belt connector attached to and extending normal to a first horizontal section of the horizontal sections;

a second belt connector attached to and extending normal to a second horizontal section of the horizontal sections in an opposite direction from the first belt connector;

a first counterweight;

a first belt attached to the first belt connector, the upper structure via a first pulley, and the first counterweight;

a second counterweight; and a second belt attached to the second belt connector, the upper structure via a second pulley, and the second counterweight.

2. A deployable vehicle barrier, the barrier comprising:

an upper structure having opposed first and second sidewalls and a top plate and a bottom plate forming a vertical passage;

opposed legs extending vertically downward from the bottom plate, each of the legs having a channel;

a bollard disposed in the passage;

parallel plates each having a vertical section inside of the bollard and a horizontal section positioned outside of a bottom end of the bollard with the horizontal sections located in the channels;

a first belt connector attached to and extending normal to a first horizontal section of the horizontal sections;

a second belt connector attached to and extending normal to a second horizontal section of the horizontal sections in an opposite direction from the first belt connector;

a first counterweight positioned below the first sidewall;

a first belt attached to the first belt connector, the first sidewall via a first pulley, and the first counterweight;

a second counterweight positioned below the second sidewall;

a second belt attached to the second belt connector, the second sidewall via a second pulley, and the second counterweight; and a motor coupled to first belt.

3. The barrier of claim 2, wherein the belt is a fiberglass reinforced neoprene belt.

4. The barrier of claim 2, wherein the belt is a chain.

5. A bollard, comprising:

a steel tubular;

a first plate having a first vertical section inside of the steel tubular and a first horizontal section positioned outside of a bottom end of the steel tubular; and a second plate having a second vertical section inside of the steel tubular and a second horizontal section positioned outside of the bottom end of the steel tubular.

6. The bollard of claim 5, further comprising a first arm attached to the first horizontal section and extending radially from the steel tubular; and a second arm attached to the second horizontal section and extending radially from the steel tubular in an opposite direction from the first arm.

7. The bollard assembly of claim 5, wherein the first plate and the second plate are parallel to each other.

* * * * *